United States Patent [19]

Noren

[11] 4,088,145

[45] May 9, 1978

[54] TANDEM RACK DISHWASHING MACHINE

[76] Inventor: Tore H. Noren, 3200 Lakeville Hwy., Petaluma, Calif. 94952

[21] Appl. No.: 733,387

[22] Filed: Oct. 18, 1976

[51] Int. Cl.[2] ..... B08B 3/02

[52] U.S. Cl. ..... 134/104; 134/186; 137/575

[58] Field of Search ..... 134/104, 111, 186, 200; 137/575

[56] References Cited

U.S. PATENT DOCUMENTS

| | | | |
|---|---|---|---|
| 1,825,033 | 9/1931 | Walker | 134/104 UX |
| 2,681,658 | 6/1954 | Meeker et al. | 134/111 |
| 2,746,467 | 5/1956 | Dempsey et al. | 134/111 |
| 3,624,750 | 11/1971 | Peterson | 134/104 X |
| 3,949,772 | 4/1976 | Hartmann | 134/104 X |

FOREIGN PATENT DOCUMENTS

| | | | |
|---|---|---|---|
| 1,202,546 | 8/1970 | United Kingdom | 134/111 |

*Primary Examiner*—Robert L. Bleutge
*Attorney, Agent, or Firm*—William R. Piper

[57] ABSTRACT

A tandem rack dishwashing machine in which the single unit model is designed to handle two half-racks at a time and arranged in tandem, the half-racks supporting solid dishes, or one full rack at a time; and in which the double unit model is designed to handle two full racks of soiled dishes at a time and arranged in tandem, the double unit model having a control switch in series with a starting switch and positioned at the exit end of the machine so as to be closed by the racks only when the two full racks are received within the washing and rinsing area. The dish-rinsing water need not be at 180° F., because the rinse water is chemically sanitized and need be only at 140° F., which is the same temperature as the wash water. Novel structure is used for quickly draining the wash water from the machine into a holding reservoir which then feeds it into the sewer. This reduces the time required between the draining of the wash water and the filling of the machine tank with the required amount of rinse water and thereby reduces the time required for the complete washing, rinsing and sterilizing of the dishes.

3 Claims, 15 Drawing Figures

FIG. 8.
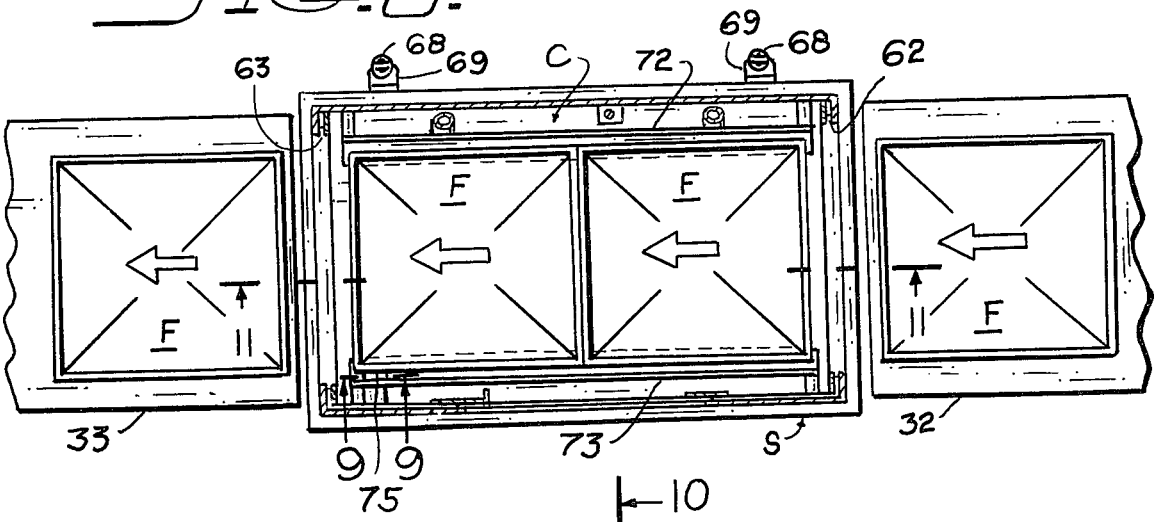
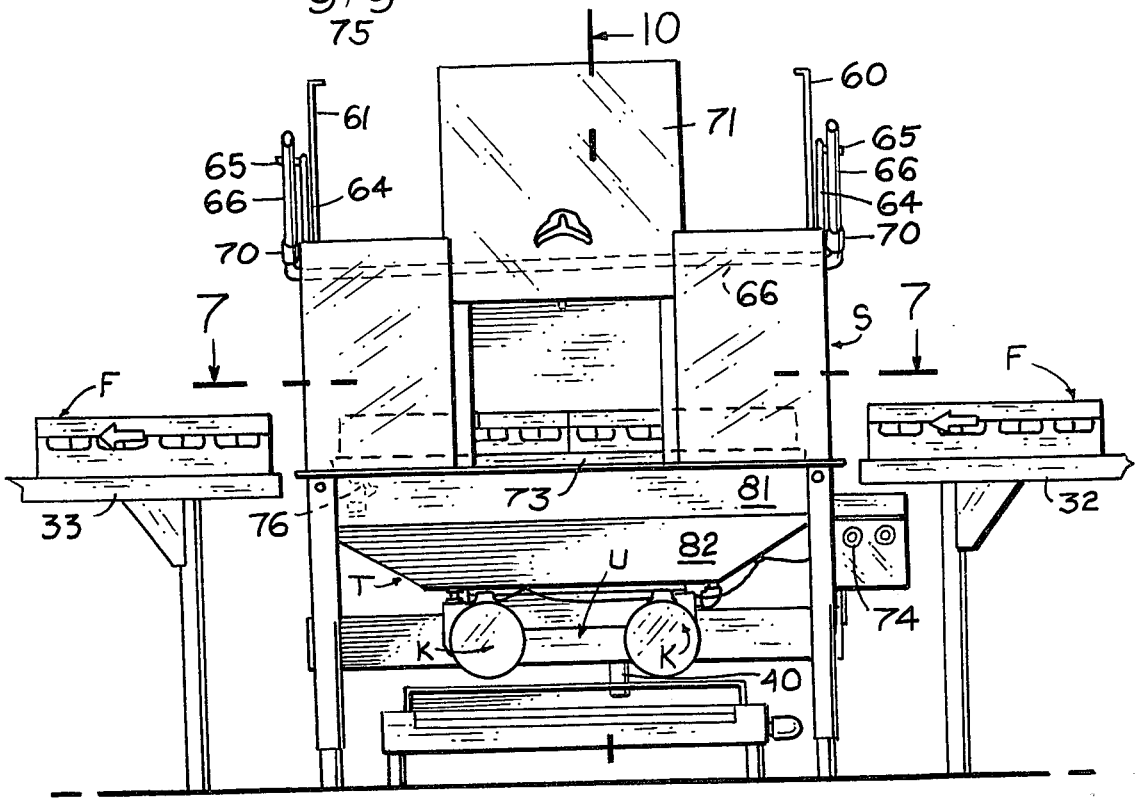
FIG. 7.
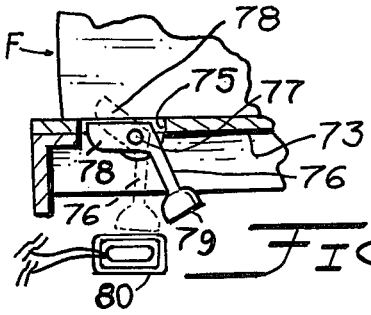
FIG. 9.

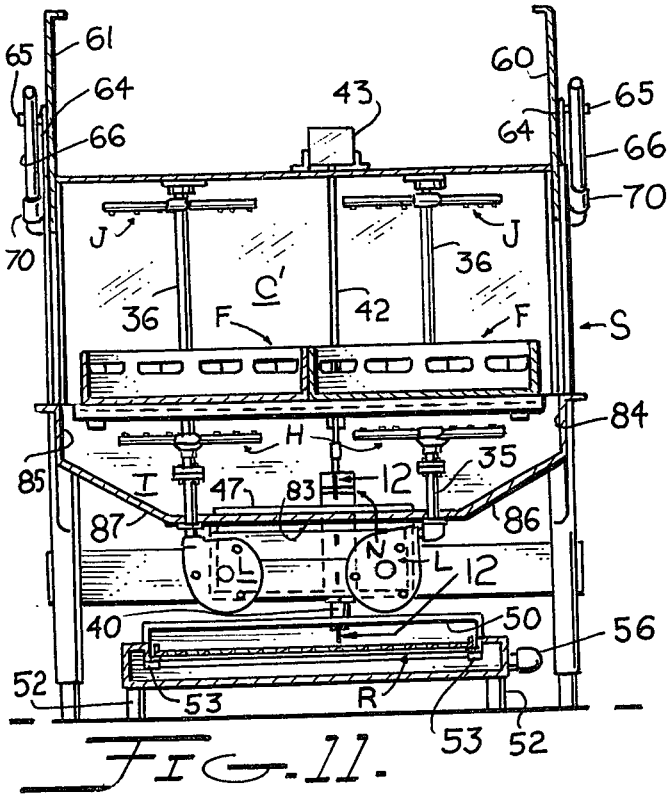
FIG. 11.
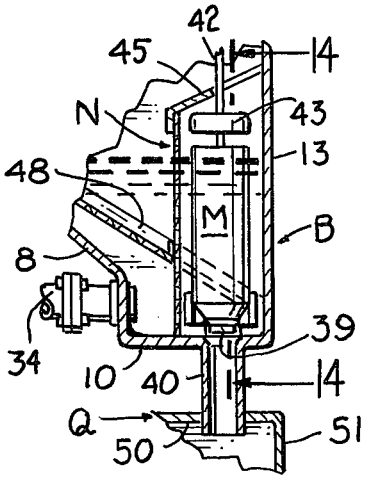
FIG. 12.
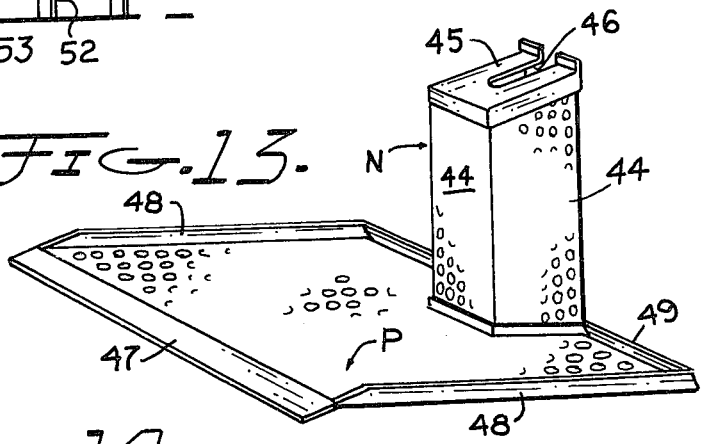
FIG. 13.
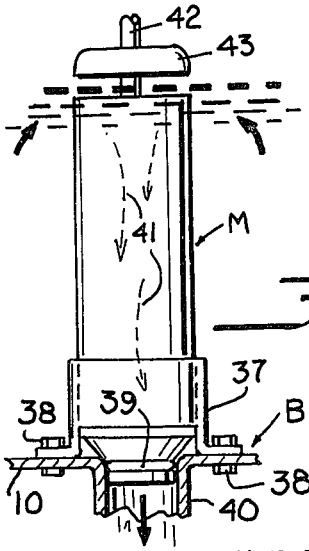
FIG. 14.
FIG. 15.
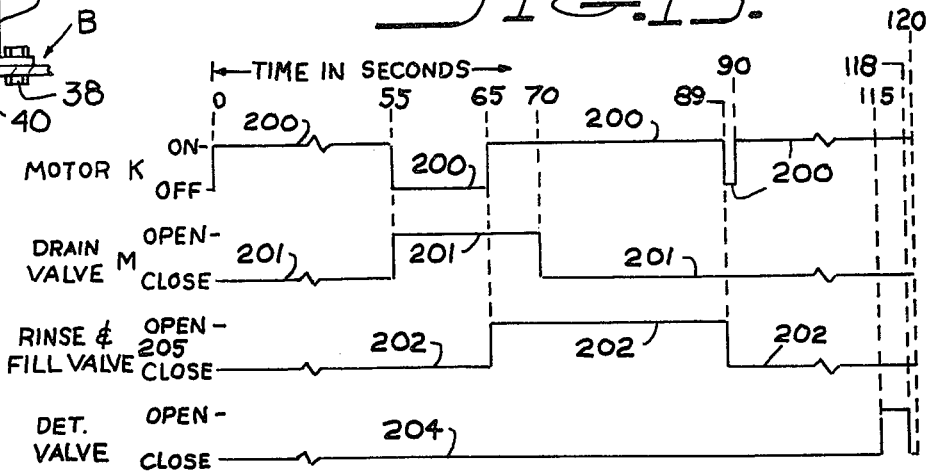

TANDEM RACK DISHWASHING MACHINE

SUMMARY OF THE INVENTION

An object of my invention is to provide a dishwashing machine that can handle twice the normal load of dishes usually handled by a standard dishwasher in which a single compartment is used for the washing, rinsing and sterilizing the dishes and a single tank is used for first holding the wash water and then for holding the rinse water. This is accomplished by the rapid draining of the wash water from the dishwasher tank into a water holding reservoir at the completion of the washing cycle and permitting the holding tank to deliver its water into the sewer at a slower speed while the dishwasher is washing the next set of soiled dishes. As soon as the dishwasher tank is emptied of its wash water it is immediately filled with a chemically treated rinse water at 140° F. temperature. The time between the wash and rinse cycles is drastically reduced. Also a less volume of water is needed for washing, rinsing and sterilizing the dishes because the small amount the machine tank holds is quickly drained at the end of the wash cycle and the chemically treated rinse water is held over for the next wash cycle.

BRIEF DESCRIPTION OF THE DRAWINGS

FIG. 7 is a front elevation of the double unit of the dishwasher and illustrates how two full size dish holding racks are receivable in tandem within the washing and rinsing compartment.

FIG. 8 is a horizontal section through the double unit dishwasher and is taken along the line 8—8 of FIG. 7.

FIG. 9 is an enlarged longitudinal section through a portion of the double unit dishwasher to illustrate the control switch actuated by the leading dish-supporting rack when moved into the washing and rinsing compartment. The section is taken along the line 9—9 of FIG. 8.

FIG. 11 is a longitudinal vertical section through the double unit dishwasher and is taken along the line 11—11 of FIG. 8.

FIG. 12 is an enlarged vertical transverse section through a portion of the double unit dishwasher and is taken along the line 12—12 of FIG. 11 to illustrate a part of the refuse holding screen and the fixed casing with perforated walls that encloses the dual drain valve and water overflow unit shown in elevation and in open position.

FIG. 13 is an enlarged perspective view of the refuse holding removable screen as shown in association with the fixed casing having perforated walls, the dual drain valve and overflow unit not being illustrated in this FIG.

FIG. 14 is an enlarged elevational view of the dual drain valve and overflow unit shown in closed position with the overflow in operation. This FIG. is taken along the line 14—14 of FIG. 12.

FIG. 15 is a diagrammatic showing of the various timing cycles.

DESCRIPTION OF THE PREFERRED EMBODIMENTS

In carrying out my invention I provide what I term a single unit dishwasher in FIGS. 1 to 6 inclusive and a double unit dishwasher in FIGS. 7 to 14 inclusive. Both are substantially identical in construction and the main difference is that the double unit dishwasher is of twice the capacity as the single unit and it makes use of a control switch that is only closed when two full-sized racks of dishes are moved into the wash/rinse compartment in tandem and then the machine will carry through its programmed cycles of washing, rinsing and sterilizing the dishes when the starting switch is closed. In the single unit dishwasher the wash/rinse compartment is large enough to receive two halfracks of dishes in tandem or one full rack of dishes. I will first describe the structure of the single unit dishwasher and follow this with a description of the double unit dishwasher.

Figure 1:
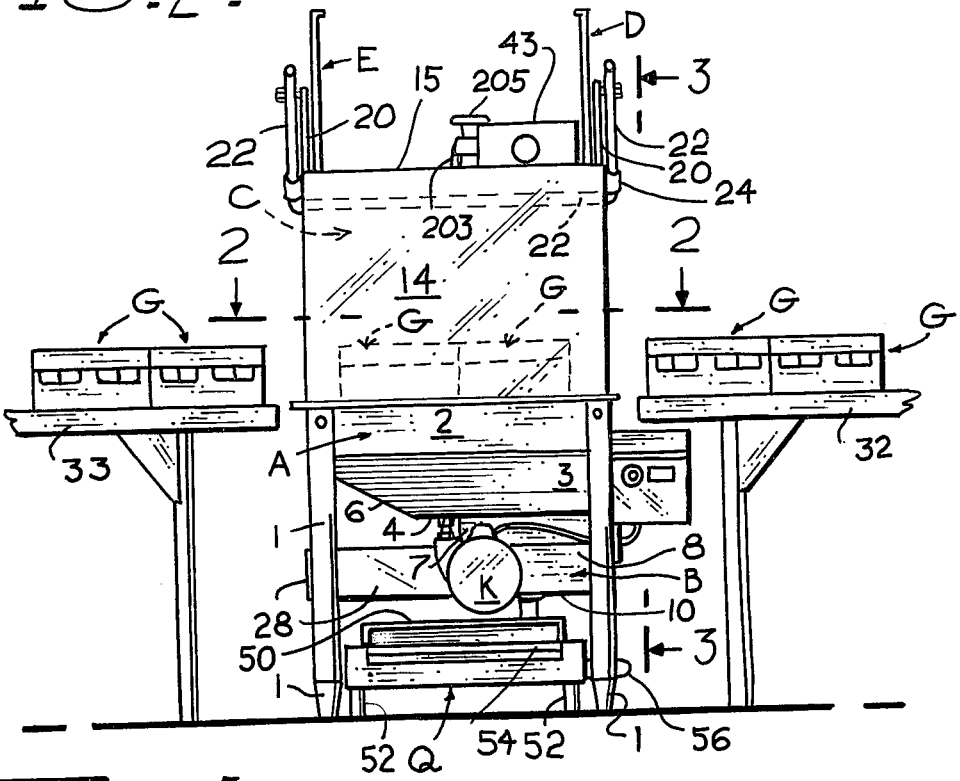
FIG. 1 is a front elevation of the single unit of the dishwasher and illustrates how two half-racks, arranged in tandem, can be received in the washing and rinsing compartment.
Figure 3:
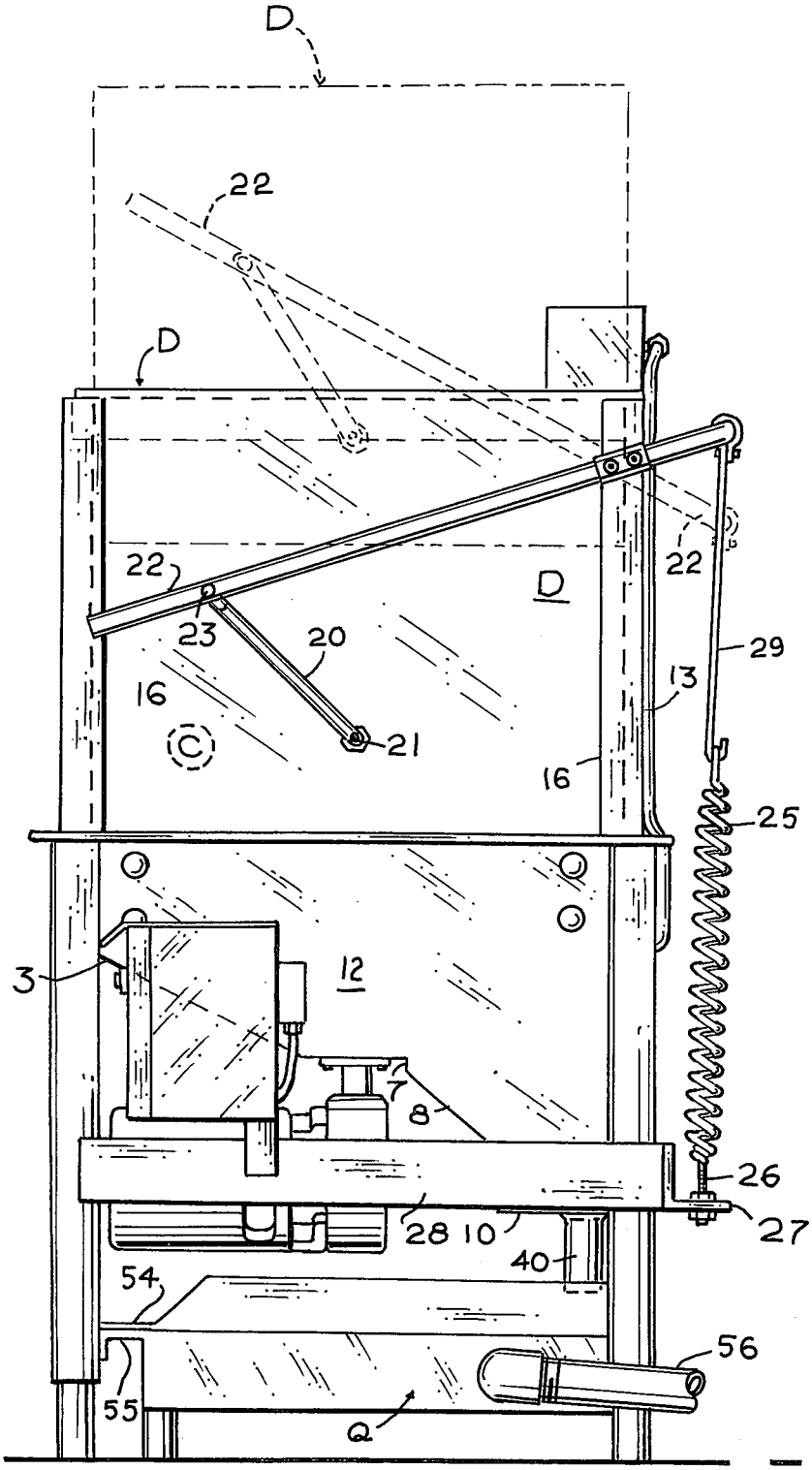
FIG. 3 is an enlarged end elevation of the single unit machine when looking in the direction of the arrows 3—3 of FIG. 1 and at the right hand end of the machine.
Figure 4:
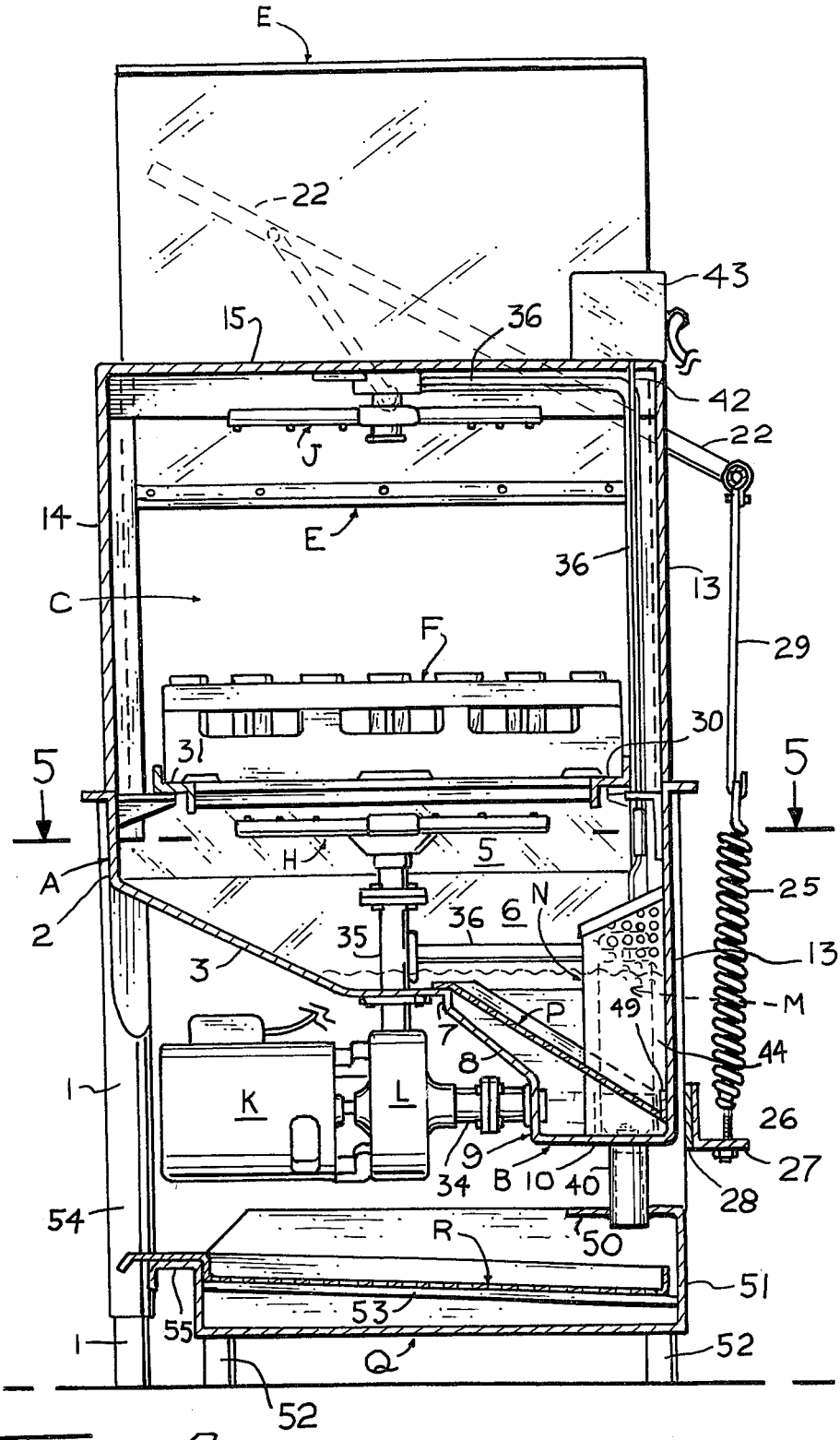
FIG. 4 is an enlarged vertical transverse section through the single unit machine and is taken along the line 4—4 of FIG. 2.
Figure 5:
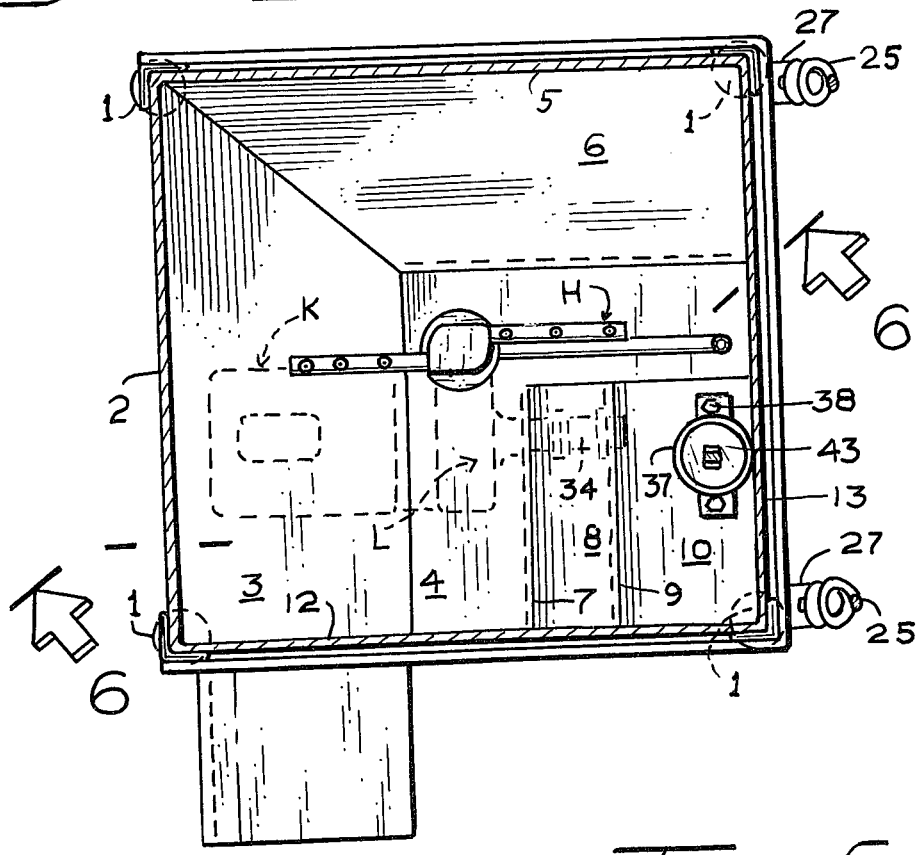
FIG. 5 is a horizontal section through the single unit machine and is taken along the line 5—5 of FIG. 4. The removable refuse holding screen is not shown in this FIG.
Figure 6:
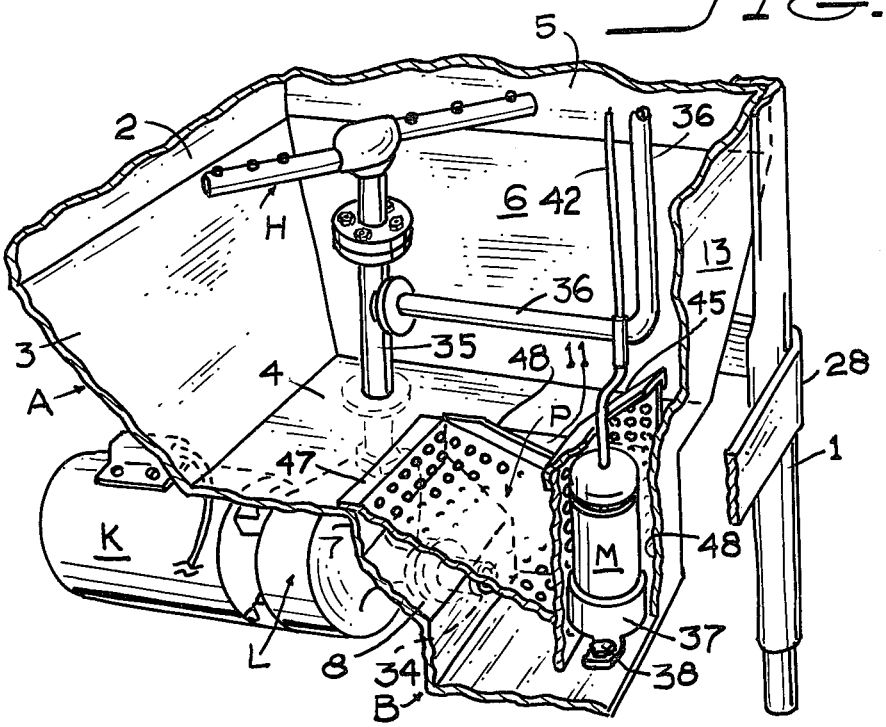
FIG. 6 is a vertical perspective view of a portion of the single unit machine and is taken substantially along the line 6—6 of FIG. 5. The removable refuse holding screen and the fixed casing with perforated walls that enclose the dual drain valve and water overflow are partially shown in this FIG.

FIG. 1 shows a front elevation of the single unit dishwasher and FIG. 3 illustrates an enlarged side elevation while FIG. 4 is a vertical transverse section through the machine. The sectional view shows a hot water holding tank indicated generally at A and designed to hold about two gallons of hot water. This tank is supported by legs 1, and the tank is shaped with a vertical front wall 2, short in height, and a downwardly inclined lower portion 3 extends from the bottom of the front wall and terminates substantially at the center of the tank. FIG. 6 further illustrates on a larger scale, a portion of the tank front wall 2 and the inclined wall 3 that leads to a partial L-shaped horizontal bottom 4, see also FIG. 5. Both FIGS. 1 and 6 further show the tank A with a vertical side wall 5 merging into a downwardly inclined side wall 6 which in turn terminates at the L-shaped bottom wall 4.

The bottom wall 4 of the tank A borders the top of a sump indicated generally at B, see FIG. 6. This sump has a short vertical wall portion 7 followed by a downwardly inclined wall portion 8 and terminating in another vertical wall portion 9 that extends above a bottom sump horizontal wall 10. The left hand wall of the sump B is vertical and extends from the L-shaped bottom wall 4 of the water tank A to the bottom wall 10 of the sump, as shown in FIG. 6. A common right hand wall 12 for the tank A and the sump B, is vertical throughout its height, see FIGS. 3 and 5, and likewise the common rear wall 13 for the tank and sump is vertical throughout its entire height.

I have gone into considerable detail in describing the walls of the water containing tank A, and the sump B because the shape is vital for the quick discharge of the hot wash water at the end of the washing cycle so as to reduce the elapsed time between the end of the washing cycle and the subsequent filling of the tank and sump with hot rinse water which precedes the rinse and sterilizing cycle. Also I provide a drain unit for the tank A, and sump B which will handle a large volume of waste water quickly so as to empty both the tank and sump in a very short time and deliver this waste water to holding tank that will permit the water to drain in a pipe leading to the sewer. During this time, the tank and sump are receiving the hot rinse water chemically treated so that this hot water need not be any greater in temperature than 140° F, and still be able to sterilize the dishes. Both the quick drain assembly and the structure of the waste water holding tank will be described later in this specification.

I will now describe the wash/rinse compartment indicated generally at C, in FIG. 4 and shown in front and side elevations in FIGS. 1 and 3, respectively. The wash/rinse compartment is disposed directly above the water holding tank A. In fact, the rear wall 13 for the sump B, and the water tank A, is extended upwardly and forms the rear wall for the wash/rinse compartment and it shows the compartment with openings 16 and 17 at both of its sides. A pair of side doors D, and E, see FIG. 1, are vertically slidable in unison in door guides 18 and 19, as shown in FIG. 2, and constitute closures for the side openings.

The doors D, and E, are spring counterbalanced in the same manner as disclosed and claimed in the U.S. Pat. of Tore H. Noren and George J. Federighi, No. 3,246,938, issued Apr. 19, 1966, of which I was one of the joint inventors. It will be seen from FIGS. 3 and 4, that the side doors D and E, each has a link 20 pivotally connected to it at 21 and the other end of each link is pivotally connected to a U-shaped, hand operated lever 22 at 23. The two handles of the U-shaped hand lever 22 are pivotally secured at 24 to the inwardly turned flanges of the rear compartment wall 13 forming one side of the two openings 16 and 17, see FIGS. 2 and 3. I use two tension springs 25—25 to counterbalance the weight of the two vertically slidable doors D, and E, and the lower ends of the two springs are adjustably connected at 26—26 to brackets 27—27 that in turn are secured to a part 28 of the dishwashing machine frame. The upper ends of the tension springs 25—25 are connected to the web portion of the U-shaped lever 22 and this is accomplished by straps 29—29, see FIGS. 3 and 4. The arrangement of the parts just described is such that the springs 25—25 will not only counterbalance the side doors D, and E, but they will also yieldingly hold the doors in closed or open position.

Figure 2:
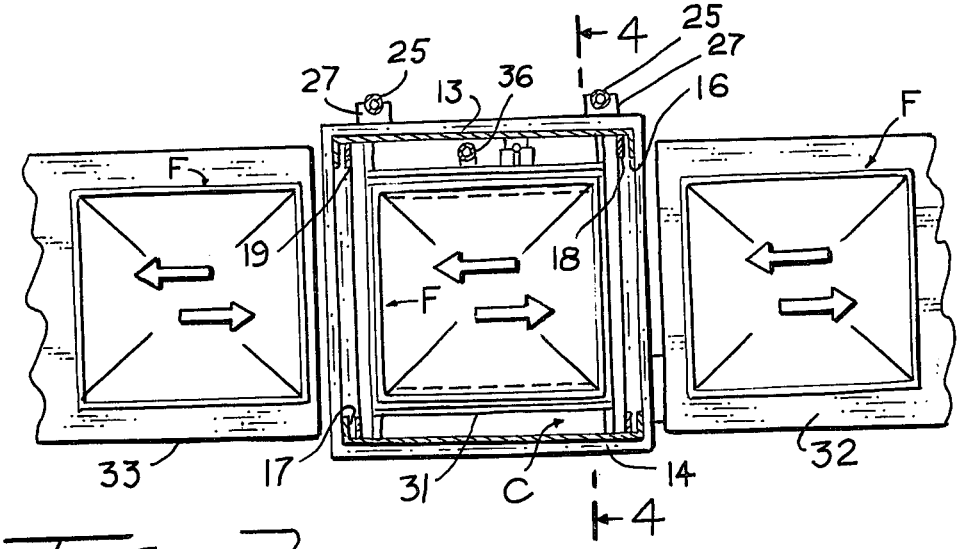
FIG. 2 is a horizontal section taken along the line 2—2 of FIG. 1 and further illustrates how the washing and rinsing compartment in the single unit machine is large enough to receive a single full size dish-carrying rack instead of the two half-racks shown in FIG. 1.

Within the wash/rinse compartment C, I mount guide and supporting rails 30 and 31, which are spaced apart and parallel each other, see both FIGS. 2 and 4 where the two rails are supporting a full size dish-carrying rack or basket F. A table 32 is placed adjacent to the side entrance 16 of the dishwasher and another table 33 is placed adjacent to the other side entrance 17, see FIG. 2. Both tables 32 and 33 are placed at the same height as the plane of the two rails 30 and 31 in the wash/rinse compartment C, so that the dish-carrying racks F may be moved into the compartment from either table or may be moved out from the compartment and onto either table at the end of the rinse and sterilizing cycle as indicated by the arrows in FIG. 2. What I have described for supporting the full-size dish-carrying rack or basket F, also holds true for the half-size racks G, shown in FIG. 1. Two of the half-size racks G would be moved into the wash/rinse compartment C before the side doors D, and E, would be closed and the dishwasher started through its wash and rinse sterilizing cycles. When the two side doors are closed the wash-/rinse compartment is completely sealed.

FIG. 4 shows a lower revolvable wash/rinse spray arm H, and an upper revolvable wash/rinse spray arm J. A motor K drives a centrifugal pump L which draws water from the sump B through a pipe 34 and forces this water through a pipe 35 to the lower spray arm H, and through a branch pipe 36 to the upper spray arm J. The washing and rinsing cycles operating in this dishwasher and the entire mechanism involved in carrying out this operation are the saem as disclosed in my U.S. Pat. No. 3,903,909, issued Sept. 9, 1975, on an apparatus for washing, rinsing and sterilizing dishes. I want to make the disclosure in U.S. Pat. No. 3,903,909, a part of the disclosure in the present case in so far as the washing and rinse/sterilizing cylces are concerned. This includes the draining of the wash water at the end of the washing cycle but the retaining of the rinse and sterilizing water at the end of the rinse/sterilizing cycle, to be used as the wash water in the next load of soiled dishes. See the diagrammatic showing of the various cycles in FIG. 15 which will be described more in detail hereinafter.

One of the vital improvements in the present invention is the rapid draining of the wash water at the termination of the washing cycle. This includes the downwardly inclined wall portion 3 that extends from the front wall 2 of the tank A to the bottom 4 of the tank, and the downwardly inclined wall portion 6 which extends from the side wall 5 of the tank to the bottom wall 4. In the single unit machine shown in FIGS. 1 to 6 inclusive, about two gallons of hot wash water is fed into the tank A and sump B so that the water level will be below the lower spray arm H. During the washing cycle this wash water has the proper amount of detergent and wetting agent fed into it in accordance with the timing cycle and apparatus set forth in my U.S. Pat. No. 3,903,909. Then at the end of the washing cycle it is vital that the wash water be drained from the tank A and sump B, as rapidly as possible in order to reduce the time taken between the end of the washing cycle and the start of the rinse/sterilizing cycle. The downwardly inclined walls 3 and 6 in the tank A aid in directing the wash water into the sump.

To assure the rapid exit of the wash water from the sump B, I have provided a novel dual drain-valve and overflow outlet for the tank A and I have also provided a novel holding tank for receiving the rapid flow of waste wash water from the tank and sump. The feeding of this waste water from the holding tank into sewer drain while the tank is being filled with rinse/ sterilizing water is one of the novel featurs of my invention. I will first describe the novel dual drain valve and overflow unit for the tank A and sump B, and then will follow this with the description of the novel waste water holding tank.

The dual drain valve and overflow unit is shown in perspective in FIG. 6 and is further shown in open position in FIG. 12 and in closed, but overflow position in the enlarged elevational view in FIG. 14. The same type of combined drain valve and overflow is used for the single unit dishwasher shown in FIGS. 1 to 6 inclusive, and in the double unit dishwasher shown in FIGS. 7 to 14 inclusive. Therefore, a detailed description of the drain valve and overflow unit will be made now and will suffice for both units.

The bottom wall 10 of the sump B supports a guide collar 37, see FIGS. 6 and 14 for the drain valve, indicated generally at M. The collar 37 is secured to the bottom wall 10 by bolts 38 and the body of the drain valve is circular in horizontal cross section and is slidably mounted in the guide collar 37. The lower end of the cylindrical drain valve M is reduced in diameter and is provided with an "O" ring 39 that will act as a washer for contactng and closing the large drain pipe 40 leading from the bottom 10 of the sump B. When the drain valve M, is in its closed position, the "O" ring 39 will seal the drain pipe 40 and will prevent any drainage of water from the sump and into the pipe 40.

However, as shown in FIG. 14, the cylindrical body of the drain valve M, is hollow and when the valve is closed, any excess water in the tank A will overflow and exit through the interior of the hollow drain valve as indicated by the dotted arrows 41 in this FIG. In the single unit, the sump B will hold about one gallon of wash or rinse water and the second gallon will partially fill the tank A. The single unit is designed to operate with about two gallons of wash or rinse water while the double unit, which will be described later, will operate with about four gallons of wash or rinse water. In both units the apparatus is designed the same as that disclosed in the Noren-Federighi U.S. Pat. No. 3,903,909, of which I was one of the joint inventors, so that the rinse water has a detergent automatically added to the water at the end of the rinse cycle and the rinse water can therefore be used as the wash water for the next load of soiled dishes, see the timing sequences in FIG. 9 of that patent. The timing sequences of the patent are made a part of the disclosure of this application so far as the automatic washing and rinsing cycles are concerned, see FIG. 15.

It might be well to set forth at this point that the open top of the drain valve M has a lift rod 42 for the drain valve M, entering a control box 43 in which an automatic mechanism is housed for lifting the drain valve at the end of the wash cycle for draining the waste wash water at the end of the wash cycle and to close the drain valve M in about five seconds after the opening of the rinse valve to allow rinse water to enter the tank and sump, again see the schematic showing of the various wash and rinse cycles in FIG. 9, of U.S. Pat. No. 3,903,909, and which is made a part of this present disclosure.

I prefer to enclose the drain valve M, in a perforated housing, as shown in detail in FIGS. 6, 12 and 13. A sectional view of the housing is illustrated in FIG. 6. The housing N has front and two side perforated walls 44, see FIG. 13, and these side walls abut the non-perforated rear wall 13 of the sump B, and tank A, with the bottom of the perforated housing resting on the bottom 10 of the sump, see FIG. 12. A removable inclined cover 45 fits over the top of the housing N, and it has a slot 46 to receive the lift rod 42 for the valve M. The purpose of the perforated housing N, is to protect the drain valve M from foreign particles. The sloping sides 3 and 6 of the tank A and the sloping wall 8 in the sump B, are specifically designed for the very rapid flow of wash water out from the tank and sump at the end of the washing cycle. The drain pipe 40 is made large in diameter for this very purpose so that when the drain valve M, is opened, the two gallons of water in the single unit will drain in about ten to fifteen seconds as shown in the timing sequences in FIG. 9 of U.S. pat. No. 3,903,909, entitled, apparatus for washing, rinsing and sterilizing dishes. FIG. 15 is similar to FIG. 9 of the patent.

The rapid outflow of wash water at the end of the wash cycle will not only greatly reduce the time lag between the wash and rinse cycles, but it will also tend to scavenge and clean any foreign material in the wash water and carry it out of the tank A, and into the sump B. It is at this point that I use an inclined refuse holding screen P, see FIGS. 4 and 13, and place it in the sump B, so that the lip 47 will rest on the bottom 4 of the tank A, adjacent to the sump wall 7, see also FIG. 6. The screen has upwardly extending side flanges 48 which contact with the side walls 11 and 12 of the sump. The lower edge of the screen has an upwardly extending flange 49, designed to contact the rear wall 13 for the sump on a line lying adjacent to the sump bottom 10, clearly shown in FIG. 4. The screen P, has a rectangular recess extending inwardly from its lower edge and designed to contact with the three outer walls of the perforated housing N. The screen will catch and retain any refuse in the wash water during the rapid emptying of this water at the end of the wash cycle while permitting the wash water to pass therethrough quickly and into the drain pipe 40 so long as the drain valve M remains open, see FIG. 12. The screen may be removed for cleaning from time to time while the perforated housing is preferably fixed in its position. The screen flange 49 has an offset portion to contact the walls 44 of the perforated housing N.

A problem presents itself when about two gallons of wash water are emptied from the washing machine and sump at the end of the wash cycle in about ten to fifteen seconds and that is some storage must be provided to temporarily hold this waste wash water outside of the machine while the rinse water is being fed into the machine. Also, this waste wash water must be delivered from the temporary storage into the sewer pipe at a volume of flow that the sewer pipe can take without backing up and possibly overflowing. To accompish this, I illustrate in FIGS. 1, 3, 4 and 11, a waste water receiving reservoir Q, large enough in capacity to receive the entire volume of waste water from the tank A and sump B. The front and side views of the reservoir Q, are shown in FIGS. 1 and 3, respectively.

A transverse sectional view of the waste water receiving reservoir Q, is shown in FIG. 4. The drain pipe 40 from the sump B, has its outlet end extending through an opening in a horizontal flange 50 that covers a top rear portion of the reservoir. The flange 50 is integral with the rear wall 51 of the box-shaped reservoir and it functions as a splash plate for the rapidly flowing waste wash water from the sump drain pipe 40 into the temporary reservoir Q. The reservoir is supported by legs 52 and it has downwardly inclined and inwardly extending side flanges 53 for removably receiving a screen R, see FIGS. 1, 4 and 11. The screen R has a transversely extending handle 54 at its front portion which overhangs a front lip 55 on the reservoir Q. Referring to FIG. 3, it will be seen that the temporary waste water receiving reservoir Q, has an outlet pipe 56 that drains directly into the sewer, not shown. The diameter of the outlet pipe 56 is such that the volume of waste wash water flowing therethrough will not exceed the capacity of the sewer pipe that receives this water. This will prevent any overflow or backing up of the water in the sewer pipe. The point to keep in mind is that the diameter of the drain pipe 40 for the tank and sump of the dishwasher is large enough to permit the rapid draining of the waste wash water into the temporary reservoir Q so that the tank and sump can quickly receive the rinse water without an undue loss of time. The timing sequence set forth in FIG. 15, controls this. The reservoir Q holds the waste wash water and feeds it into the outlet pipe 56 at the proper volume of flow and this can be taking place while the tank and sump are receiving the rinse water and even while the dishwasher starts on its rinse cycle.

Before describing the various washing and rinsing cycles shown in FIG. 15, I will first describe the dishwasher double unit shown in FIGS. 7 to 11, inclusive. This double unit machine in many respects is the same as the single unit shown in FIGS. 1 to 6, inclusive. The principal difference is that the double unit is designed to accommodate in tandem, two full size dish-carrying racks F, in the enlarged wash/rinse compartment C', rather than a single rack as illustrated in the single unit of FIGS. 1 and 2. The elongated wash/rinse compartment C', shown in FIGS. 7 and 8 has two doors 60 and 61, similar to the doors D and E, of the single unit shown in FIGS. 1 and 2. The vertically movable doors 60 and 61 normally close the two openings 62 and 63, respectively, of the wash/rinse compartment C'. The two end doors 60 and 61 are interconnected and counterbalanced by the same type of mechanism shown in FIGS. 1 and 3 for interconnecting and counterbalancing the doors D and E, of the single unit. The door 60 is the entrance door and the door 61 in FIG. 7, is the exit door.

Figure 10:
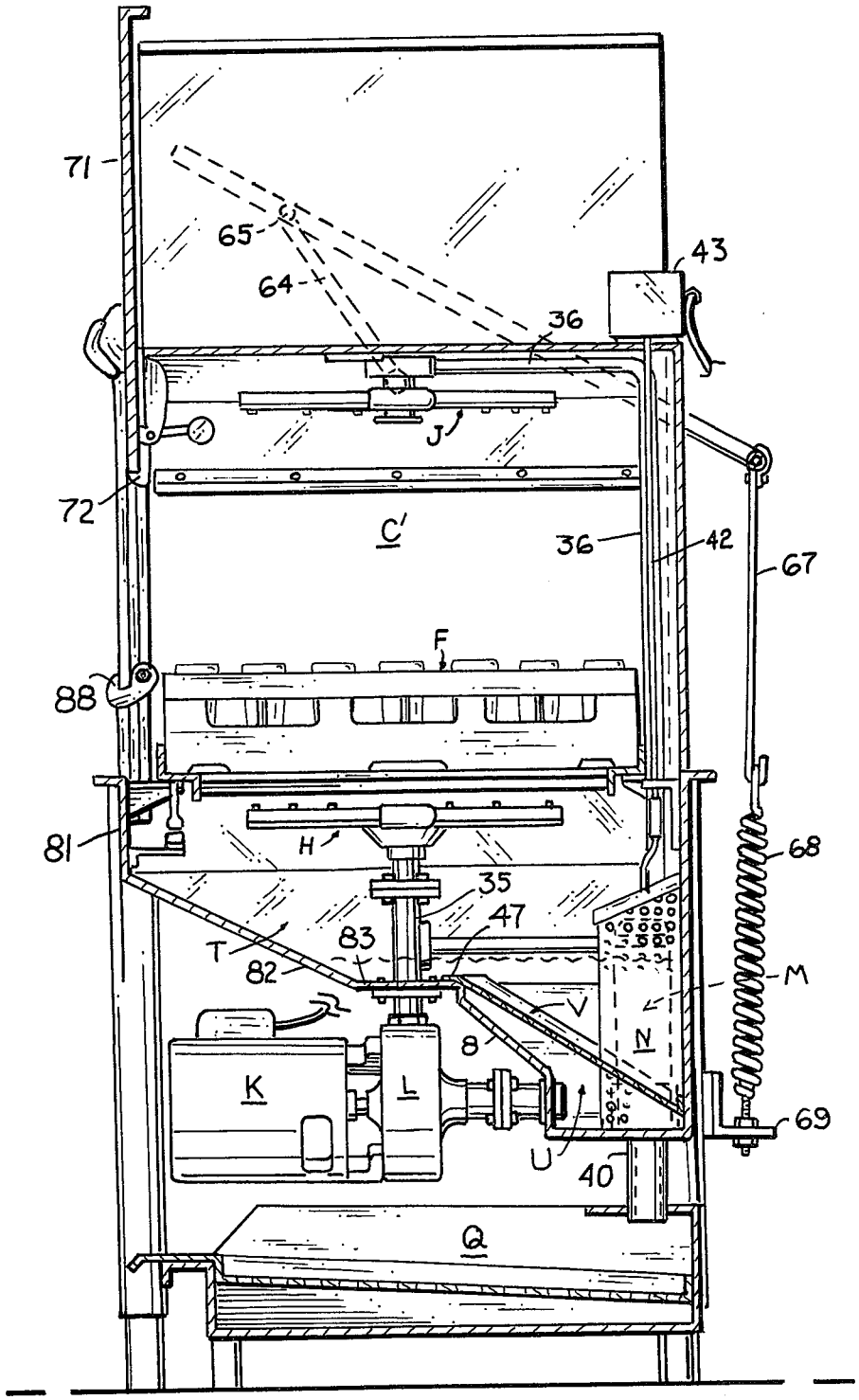
FIG. 10 is an enlarged vertical transverse section through the double unit dishwasher and is taken along the line 10—10 of FIG. 7.

The door raising and lowering mechanism includes a link 64 for each door 60 and 61 with one end of the link pivotally connected to the side of the door and its other end pivotally connected at 65 to the arms of a U-shaped, hank-operated lever 66, see FIGS. 7 and 10. The web portion of the U-shaped lever 66 is shown by dotted lines in FIG. 7 and a pair of straps 67, see FIG. 10, have their upper ends secured to the web portion of the U-shaped lever while the lower ends of the straps are connected to tension springs 68, see also FIG. 8. The lower ends of the springs are adjustably connected to brackets 69 that in turn are secured to the frame of the dishwasher. The handles of the U-shaped lever 66 are pivotally connected at 70 to the ends of the dishwasher frame. An operator can open or close the end doors 60 and 61 by actuating the handles of the U-shaped lever 66 and the springs 68 will counterbalance the weight of the doors and will yieldingly hold them in open or closed position.

The length of the wash/rinse compartment C', in FIG. 8, is long enough to accommodate two full sized dish-carrying racks F when they are arranged in tandem. I have provided a central inspection door 71 that may be raised by the operator, see FIG. 7, in case he wishes to inspect the interior of the wash/rinse compartment C'. A counterbalanced pivoted hook 72 can hold the door 71 in raised position, as shown in FIG. 10, and if desired this hook may open a switch, not shown, for opening the operating electric circuit when the door is held open so as to prevent the dishwasher from operating so long as the center door 71 is open. A safety catch 88 is placed above the closed position of the center door to catch the door should it accidentally fall so as to protect the fingers of the operator.

FIGS. 7 and 8 show the tables 32 and 33 placed adjacent the ends of the double unit dishwasher indicated generally at S. The dish containing racks F, are moved from the table 32 into the dishwasher and are supported and guided by spaced apart and parallely arranged rails 72 and 73, see FIG. 8. As already stated, the double unit dishwasher S, is long enough to receive two full sized dish containing racks when arranged in tandem and these are moved into the wash/rinse compartment C' from the open right hand end of the machine. In order to compel an operator to have to move two dish containing racks F, into the wash/rinse compartment C' before the dishwasher can be operated, I mount an automatic switch adjacent to the exit end of the compartment and this switch must be closed by the leading rack F before the machine will function even though the normal starting switch button 74 is depressed.

In FIG. 9, I illustrate one type of automatic switch which is similar to the automatic switch shown in FIG. 1 of the George J. Federighi and Tore H. Noren U.S. Pat. No. 2,668,548, issued Feb. 9,1954, of which I was one of the joint inventors. The guide and supporting rail 73 in FIG. 9 has an opening 75 therein and a weighted arm 76 is pivoted at 77 and has an integral finger-shaped end 78 projecting through the opening 75 and into the path of the movable racks F when the arm is in normal position, see the dot-dash line position of the arm 76 in FIG. 9. The lower end 79 of the arm carries a horseshoe magnet, not shown, and the magnet attracts a magnetizable terminal in a mercury switch 80 to keep the switch open so long as the weighted switch arm 76 remains in normal position. The mercury or micro switch is in series with the starting switch that is closed when the starting button 74, see FIG. 7, for the machine, is depressed.

The purpose for the weighted switch arm 76 when in normal position maintaining the mercury switch 80 in open position, is to prevent the double unit dishwasher S, from being operated when only one dish-carrying rack F, is moved into the wash/rinse compartment C' and the starting switch button 74 is depressed. The single rack F will not be moved far enough for it to strike and swing the finger 78, see the finger underlying the left hand rack F, in FIG. 8. The purpose of the double unit is to wash and rinse the dishes in two racks, tandemly arranged, in the same length of time as required for the single unit dishwasher shown in FIGS. 1 and 2 to wash and rinse the dishes in a single rack. I will describe hereinafter how the double unit uses about twice the volume of water as the single unit, but yet the time required to do this is the same as in the single unit. When two trays F, in tandem, are moved into the wash-/rinse compartment C' from the right hand end of the machine, the left hand rack in FIGS. 7 and 8 will strike and depress the weighted switch arm 76 for swinging the magnet holding end 79 of the arm, away from the mercury switch 80 and permitting its electrodes to close and close a circuit for operating the machine when the starting button 74 is depressed. It is possible to place the weighted switch arm 76 at the right hand end of the double unit dish-washer S, if the trays F, are to be fed into the wash/rinse compartment C' from the left hand end of the machine.

I will now describe how the tank size for the double unit dishwasher S, is designed to hold about twice the volume of hot water than that is held by the single unit shown in FIGS. 1 and 2. In FIGS. 7 and 10, I show the hot water holding tank T, underlying the wash/rinse compartment C'. The tank T has a vertical front wall 81 and a downwardly inclined wall 82 extending from the front wall to a bottom wall 83, see FIG. 11. The tank T also has two vertical end walls 84 and 85 that have downwardly inclined walls 86 and 87, respectively, leading to the bottom wall 83.

A sump U communicates with and underlies the tank T and it is somewhat similar to the sump B of the single unit, but of a larger capacity, see FIGS. 10 and 11. The sump U has a downwardly inclined removable screen V, similar to the screen P of the single unit. The screen P, is shown in FIG. 13, and the detailed description for the screen P will be applied to the screen V of FIG. 10 with like reference numerals being applied to similar parts. The only difference between the two screens P, and V lies in the fact that the screen V, is wider so as to fit the larger sump U, and the offset portion of the lower flange 49 of the screen P must be at a different location so as to accommodate the centrally disposed perforated housing N, see FIG. 10 for the double unit and FIG. 13. The detailed description of the perforated housing N, in FIG. 13 will suffice for the same type of perforated housing N, shown in FIG. 10 used in the double unit and like reference numerals will be applied to similar parts.

The perforated housing N of FIG. 10 encloses the combination waste water drain valve M, and overflow unit illustrated in FIGS. 12 and 14. Since the double dishwasher unit S of FIGS. 7 to 11 inclusive, makes use of an identical drain valve and overflow unit M shown in FIGS. 12 and 14 and used in the single unit dishwasher, the detailed description already given for the unit M, and associate parts will apply and like reference characters will be used.

In FIG. 11, I show the double unit dishwasher S, provided with two pumps L that remove water from the sump U, and deliver it to their associate lower spray arms H, and upper spray arms J, through pipes 35 and 36, respectively. This part of the apparatus for the double unit is precisely the same as that for the single unit dishwasher. About four gallons of hot water are used in the double unit S, and two sets of wash and spray arms H, and J, are used, one set for each dish-carrying rack F, as clearly shown in FIG. 11. Similar reference characters used in describing the wash and rinse apparatus for the single unit dishwasher will be used for like parts used in the double unit dishwasher of FIG. 11 and further detailed description of this apparatus need not be given.

The double unit dishwasher S, in handling about four gallons of hot water in the washing and rinsing of the dishes, makes use of two pumps L, and two motors K, see FIGS. 7, 10 and 11. Each one of the two racks F has its own lower and upper rinse arms H and J, and therefore the washing and rinsing cycles can take place in substantially the same length of time as is required in the single unit dishwasher. The downwardly inclined end walls 86 and 87 for the tank T, will cause the water in the tank to quickly flow into the sump U when the drain valve M, is opened. The downwardly inclined wall 8 in the sump U, see FIG. 10, will likewise speed up the flow of water out of the sump and through the drain pipe 40 which empties into a waste water receiving reservoir Q, see FIG. 11. I have used the same letter Q for the reservoir shown in FIG. 11 as that shown at Q in FIG. 1, because both are similar in construction except the reservoir Q in FIG. 11 is made large enough in capacity to hold twice the water volume from the double dishwasher unit S than that is held from the single unit dishwasher shown in FIG. 1. Like reference characters are used in both reservoirs for similar parts.

Both the single and double unit dishwashers use the same cycles of washing, rinsing and sterilizing of dishes as set forth in FIG. 15 which is similar to FIG. 9 of the Tore H. Noren and George J. Federighi U.S. Pat. No. 3,903,909, issued Sept. 9, 1975, of which I was one of the joint inventors. The graph shown in FIG. 15, covers a time period of 120 seconds or two minutes during which the wash, rinse and sterilizing cycles of the dish-washer are carried out. The top line 200 indicates when the motor K is operating and when it does, it will operate the pump L, and cause either hot wash water or hot rinse water to be sprayed onto the dishes. The second line 201 shows when the drain valve M, is open or closed while the third line 202 indicates when the rinse and fill valve, not shown, is opened or closed to control the flow of fresh hot water through the pipe 203, see FIG. 1, and into the dishwasher. The bottom line 204 indicates when the detergent valve, not shown, is opened and closed.

It should be remembered that both the single and double unit dishwashers make use of the hot rinse water after the rinse and sterilizing cycle and use it in the following wash cycle for the next dishwashing operation by adding a detergent at the end of the rinsing and sterilizing cycle. Also, the hot rinse water need only be 140° F, rather than 180° F, for rinsing and sterilizing the dishes because a sterilizing chemical such as chlorine, is added to the hot rinse water as it enters the dishwasher and this is disclosed in U.S. Pat. No. 3,309,909, of which I am one of the joint inventors.

The time periods for the wash and rinse cycles are substantially the same for the single unit dishwasher and the double unit dishwasher. FIG. 15 represents a wash-/rinse cycle after the commercial dishwasher has finished washing, rinsing and sterilizing one set of dishes and is ready to start on the next set of dishes and is using the hot rinse water held over from the previous dishwashing operation and to which a detergent has been added. The top graph line 200 in FIG. 15 shows that the motor K has been turned on and it will operate the pump L for a period of 55 seconds at which time it is turned off for 10 seconds. What is said for the motor K and the pump L for the single unit dishwasher shown in FIGS. 1 to 6 inclusive, also holds true for the two motors K and two water pumps L, in the double unit dishwasher shown in FIGS. 7 to 11 inclusive.

At the end of the washing cycle which lasts for about 55 seconds, the drain valve M opens, see the graph line 201 in FIG. 15, and stays open for 15 seconds after which the valve closes. The rinse and fill valve 205, see FIG. 1, and represented by the graph line 202 in FIG. 15, opens at 65 seconds and permits fresh hot water at 140° F to flow into the tank A, 5 seconds before the drain valve M closes in order to flush out the wash water. The drain valve M closes at 70 seconds, see graph line 201, and the rinse and fill valve 205 remains open until 89 seconds is reached on the graph line 202 whereupon this valve closes. During this inflow of about 2 gallons for the single unit dishwasher and 4 gallons for the double unit dishwasher, a sanitizing agent, such as chlorine, is mixed with the hot water in sufficient quantity to permit the hot water temperature to be at 140° F, rather than at a required 180° F, should no sterilizing agent be added.

It is a vital and novel point to remember that the tank and sump in both the single and double dishwashing units are shaped to expel the wash water in 15 seconds which holds true for the 2 gallons used in the single unit or the 4 gallons in the double unit. The drain valve M and the drain pipe 40 are made large enough to expel this waste water in the 15 second period lying between the 55 second and 70 second positions on the graph in FIG. 15. The waste water receiving reservoir Q for the single and double unit dishwashers is also made large enough to receive the waste water and permit the hot rinse water to start flowing into either type dishwasher at the 65 second position to flush out the waste water and then to deliver the required 2 or 4 gallons to the single or double unit from the 70 second position to the 89 second position. Two motors K, and two pumps L, are used in the double dishwasher unit so that each pump is still handling the same volume of water as is handled by the single motor and pump used in the single dishwashing unit. The waste water receiving reservoirs Q will have ample time to deliver the waste water into the outlet pipe 56 that leads to the sewer during the rinsing cycle and the following wash cycle for the next set of dishes before the next waste wash water is fed into the reservoir. There will be no backing up of waste water into the dishwasher nor any clogging of the drain pipe 56. The screen P, in the sump B, and the screen R, in the waste water receiving reservoir Q can be removed and cleaned from time to time. The drain pipe 40 and the drain valve M for the double unit dishwasher could be larger so as to handle the larger volume of water in about the same length of time as required for handling the waste water from the single unit.

There is a one second period between the 89 second position and the 90° position in the motor K graph line 200 where the motor stops and the pump L will also stop to permit any trapped air in the pump to escape, see FIG. 15. The rinse and sterilizing cycle will extend from the 90 second position to the 120 second position, see graph line 200, where upon the motor K will automatically stop. Referring to the bottom graph line 204 it will be seen that a detergent valve, not shown in the present drawings, but shown, described and claimed in U.S. Pat. No. 3,903,909, already referred to, will be opened at the end of the rinse/sterilizing cycle as indicated at the 115 second position. This detergent valve will remain open for 3 seconds or until the 118 second position whereupon it will close. A sufficient amount of detergent will be fed into the rinse hot water so that this water can be used as the wash water for the next set of dishes to be washed. In this way the volume of hot water needed for washing and rinsing dishes is cut in half. Also, the rinse cycle can follow the wash cycle within 15 seconds thereby reducing the entire washing, rinsing and sterilizing cycles to 120 seconds or two minutes.

I claim:

1. A dishwashing machine comprising:

(a) a dishwashing compartment;

(b) a tank underlying said compartment for receiving water therefrom;

(c) a sump underlying said tank for receiving water therefrom;

(d) means for circulating water from said sump to said compartment and including spraying arms for washing the dishes in said compartment;

(e) a waste water drain pipe for said sump and a drain valve controlling the outflow of water from the sump and tank and into said drain pipe with means for opening and closing said drain valve;

(f) a waste water receiving reservoir underlying said sump large enough in capacity for quickly receiving and temporarily storing all of the waste water delivered by said drain pipe from said sump and tank and into said reservoir when said valve is opened at the end of the washing operation;

(g) an outlet pipe for the waste water leading from said reservoir to a sewer for delivering the waste water from said reservoir into the sewer; and (h) means for delivering rinse water into said tank and then for closing said drain valve, the rinse water being delivered into said tank while the waste water flows from said reservoir into said outlet pipe to the sewer.

2. The combination as set forth in claim 1: and in which (a) said tank having downwardly inclined wall portions for causing a rapid flow of water into said sump from said tank and said sump having a downwardly inclined wall portion for causing a rapid flow of water from said sump and into said drain pipe when said drain pipe valve is opened, said drain pipe being large enough in diameter to handle the rapid flow of waste water from said sump and tank and deliver it into said reservoir;

(b) whereby said waste water receiving reservoir will quickly receive and temporarily contain a volume of waste water from said sump and tank greater in volume than could be handled directly by said outlet pipe if communicating directly with the drain pipe.

3. The combination as set forth in claim 1: and in which (a) said drain valve includes a hollow vertically arranged cylinder with an outer sealing ring at its lower end adapted to seat in the entrance end of said drain pipe when said valve is in closed position for closing the drain pipe, the length of the cylinder being long enough to extend to the normal water level in said tank;

(b) whereby any excess water in the tank will raise the water level above normal and permit the excess water to flow into the open top of the cylinder and exit through said drain pipe;

(c) a perforated housing enclosing the hollow cylinder of said valve; and (d) said sump having a downwardly inclined and removable screen that overlies the sump bottom and extends around said perforated housing for catching and retaining any foreign matter in the water.

* * * * *